US011877599B2

(12) United States Patent
Tong

(10) Patent No.: US 11,877,599 B2
(45) **Date of Patent: *Jan. 23, 2024**

(54) ELECTRONIC SMOKING DEVICE WITH CAPILLARY BUFFER

(71) Applicant: FONTEM HOLDINGS 1 B.V., Amsterdam (NL)

(72) Inventor: Xinliang Tong, Beijing (CN)

( * ) Notice: Subject to any disclaimer, the term of this patent is extended or adjusted under 35 U.S.C. 154(b) by 276 days.

This patent is subject to a terminal disclaimer.

(21) Appl. No.: 17/141,076

(22) Filed: Jan. 4, 2021

(65) Prior Publication Data

US 2021/0120874 A1 Apr. 29, 2021

Related U.S. Application Data

(63) Continuation of application No. 15/752,215, filed as application No. PCT/CN2015/087610 on Aug. 20, 2015, now Pat. No. 10,905,160.

(51) Int. Cl.
*A24F 40/44* (2020.01)
*A24F 40/485* (2020.01)
(Continued)

(52) U.S. Cl.
CPC ..... *A24F 40/485* (2020.01); *A24F 40/44* (2020.01); *A24F 40/48* (2020.01); *A24F 40/10* (2020.01)

(58) Field of Classification Search
CPC ..... A24F 47/008; A24F 47/002; A24F 40/00; A24F 40/10; A24F 40/44; A24F 40/48; A24F 40/485; A24F 47/004; A61K 31/465; A61M 11/041; A61M 11/042; A61M 15/0021; A61M 15/0086; A61M 15/06; A61M 2016/0021; A61M 2205/11; A61M 2205/3606; A61M 2205/3653; A61M 2205/7536; A61M 2205/8206; A61M 2205/8237; F22B 1/284; H05B 1/0244; H05B 1/0291; H05B 1/0297;
(Continued)

(56) References Cited

U.S. PATENT DOCUMENTS 8,365,742 B2 2/2013 Hon
8,833,364 B2 9/2014 Buchberger
(Continued)

FOREIGN PATENT DOCUMENTS

CN 201079011 Y 7/2008
CN 102264420 A 11/2011
(Continued)

OTHER PUBLICATIONS

European Patent Office, Supplementary European Search Report for Application No. EP15901499, dated Jul. 25, 2018, 8 pages.
(Continued)

*Primary Examiner* — Sang Y Paik
(74) *Attorney, Agent, or Firm* — Perkins Coie LLP; Kenneth H. Ohriner

(57) ABSTRACT

An electronic smoking device, comprising a capillary buffer having a first end, a second end, a capillary buffer portion between the first end and a second end, and an vapor channel and a liquid conduit formed between first end and the second end and through the capillary buffer portion; the capillary buffer portion is operable to receive under capillary effect excessive liquid from the liquid supply.

15 Claims, 5 Drawing Sheets

(51) Int. Cl.
*A24F 40/48* (2020.01)
*A24F 40/10* (2020.01)

(58) Field of Classification Search
CPC ..... H05B 2203/013; H05B 3/03; H05B 3/06; H05B 3/26; H05B 3/42
USPC ..... 392/392–398; 131/290–304
See application file for complete search history.

(56) References Cited

U.S. PATENT DOCUMENTS

| | | | | |
|---|---|---|---|---|
| 10,905,160 | B2 * | 2/2021 | Tong | A24F 40/44 |
| 2008/0037917 | A1 | 2/2008 | Henriks | |
| 2011/0226236 | A1 | 9/2011 | Buchberger | |
| 2014/0109921 | A1 | 4/2014 | Chen | |
| 2014/0305454 | A1 | 10/2014 | Rinker et al. | |
| 2015/0090279 | A1 | 4/2015 | Chen | |
| 2015/0272218 | A1 | 10/2015 | Chen | |

FOREIGN PATENT DOCUMENTS

| | | | |
|---|---|---|---|
| CN | 103932403 | A | 7/2014 |
| CN | 103948174 | A | 7/2014 |
| CN | 203851809 | U | 10/2014 |
| EP | 0893071 | A1 | 1/1999 |
| EP | 2022349 | A1 | 2/2009 |
| WO | 2015070398 | A1 | 5/2015 |
| WO | 2015117704 | A1 | 8/2015 |
| WO | 2016092261 | A1 | 6/2016 |

OTHER PUBLICATIONS

European Patent Office, Summons to Attend Oral Proceedings for Application No. 15901499.2, dated Jun. 25, 2021, 15 pages.
Buffer meaning in the Cambridge English Dictionary, https://dictionary.cambridgelorg/dictionary/english/buller dated Jun. 10, 2020, 1 page.
Communication of Notices of Opposition for Application No. 15901499.2 dated Oct. 27, 2020, 1 page.
Extract from the Register of European Patents, https://register.epo.org/application?number=EP15797159&tab=main, Jun. 10, 2020, 3 pages.
Notice of Opposition for Application No. 15901499.2 dated Oct. 21, 2020, 32 pages.
Priority document for International application No. PCT/GB2015/053445, 31 pages.
State Intellectual Property Office, First Office Action for Chinese Appl. No. 201580083968.8; dated Dec. 6, 2019; 8 pages.
Espacenet machine translation of CN103948174A, 9 pages.
European Patent Office, Extended European Search Report for European Application No. 15901499.2, dated Aug. 10, 2018, 9 pages.
State Intellectual Property Office, China PRC, "International Search Report and Written Opinion", for PCT Application No. PCT/CN2015/087610, 11 pgs.
Interlocutory decision in Opposition proceedings (Art. 101(3)(a) and 106(2) EPC) for Application No. 15901499.2 dated May 18, 2022, 94 pages.
EP Communication dated Sep. 22, 2022 enclosing the Statement of Grounds for Appeal on Behalf of the Opponent filed Sep. 16, 2022 for EP Application No. 15901499.2 (EP3337341), 20 pages.
EP Communication dated Jan. 25, 2023 enclosing Nicoventures Trading Limited's Response to Statement of Grounds for Appeal, Opposition of EP3337341 (Application No. 15901499.2), 31 pages.

* cited by examiner

ELECTRONIC SMOKING DEVICE WITH CAPILLARY BUFFER

CROSS-REFERENCE TO RELATED APPLICATION(S)

This application is a continuation of U.S. application Ser. No. 15/752,215, filed Feb. 12, 2018, which is a 371 of PCT/CN2015/087610, filed Aug. 20, 2015, which is incorporated herein by reference in its entirety.

TECHNICAL FIELD

The field of the invention is electronic smoking devices, and more particularly electronic smoking devices having improvements to prevent leaking of stored liquid.

BACKGROUND

An electronic smoking device, such as an electronic cigarette (e-cig or e-cigarette), electronic cigar, personal vaporizer (PV) or electronic nicotine delivery system (ENDS) is a battery-powered vaporizer which simulates smoking tobacco. These devices produce a vapor by supplying a liquid to an atomizer. E-liquid refers to the liquid which is atomized to produce the vapor. The main ingredients of e-liquid are usually a mix of propylene glycol (PG), glycerin (G), and/or polyethylene glycol 400 (PEG400). Various concentrations of alcohol mixed with flavorings, and nicotine, are also often included.

E-liquid is often sold in bottles or pre-filled disposable cartridges. Some e-liquid cartridges are prefilled by the manufacturer. In some cases, e-liquid is filled directly into a cartridge housing, while in other cases, porous material such as fibers made of ceramic, metal, glass and/or carbon are used to hold e-liquid within the cartridge housing or other container. If used, the porous material is in contact with a wick and/or a liquid guiding structure to convey e-liquid to the atomizer.

Generally, the e-liquid cartridge or container also contains gas, which may be present from the filling process, or may evolve from a volatile component of the liquid. Gas pressure within the liquid container may increase due to several factors. If the container is vented, rather than pressure-tight, some e-liquid may be pushed out of the cartridge by rising gas pressure, resulting in leaking liquid. Therefore, there is a need to improve e-liquid cartridges or liquid containers used with electronic vaporizing devices to reduce or prevent such leakage.

SUMMARY OF THE INVENTION

An electronic vaporizing device is design to avoid leaking of e-liquid by using a capillary buffer between a liquid supply and an atomizer in the housing of the device. The capillary buffer has a liquid conduit extending from the liquid supply to the atomizer, and buffer spaces for holding liquid pushed out of the liquid supply by gas pressure. The buffer spaces may be formed by an array of buffer plates. An air channel connects into the buffer spaces and to a vent.

DETAILED DESCRIPTION

Figure 6:
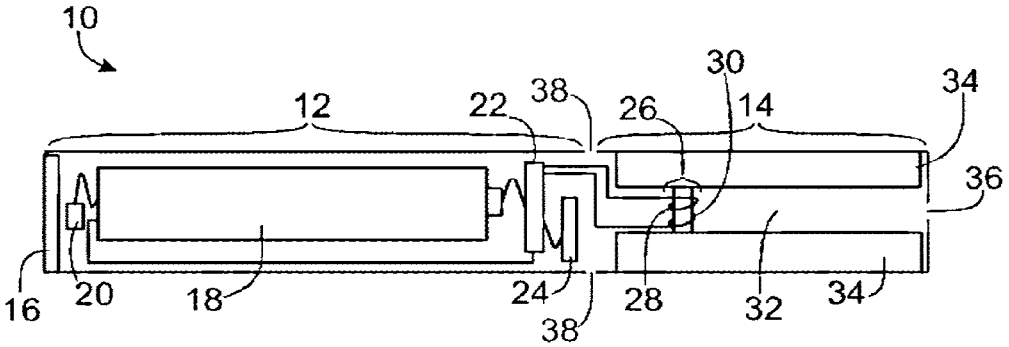
FIG. 6 is a section view of an electronic cigarette.

As is shown in FIG. 6, an electronic vaporizing device 10 typically has a housing comprising a cylindrical hollow tube having an end cap 16. The cylindrical hollow tube may be single piece or a multiple piece tube. In FIG. 6, the cylindrical hollow tube is shown as a two piece structure having a battery portion 12 and an atomizer/liquid reservoir portion 14. Together the battery portion 12 and the atomizer/liquid reservoir portion 14 form a cylindrical tube which is approximately the same size and shape as a conventional cigarette, typically about 100 mm with a 7.5 mm diameter, although lengths may range from 70 to 150 or 180 mm, and diameters from 5 to 20 mm. Vaporizing devices having refillable tanks may have larger diameters, e.g., up to about 30 or 40 mm in diameter.

The battery portion 12 and atomizer/liquid reservoir portion 14 are typically made of metal or hardwearing plastic and to provide a housing to contain the components of the e-cigarette 10. The battery portion 12 and a atomizer/liquid reservoir portion 14 may be configured to fit together by a friction push fit, a snap fit, or a bayonet attachment, magnetic fit, or screw threads. The end cap 16 is provided at the front end of the battery portion 12. The end cap 16 may be made from translucent plastic or other translucent material to allow an LED 20 positioned near the end cap to emit light through the end cap. The end cap can be made of metal or other opaque materials if no LED is used. The liquid reservoir may optionally be separate from the atomizer, so that the device has three sections or portions.

An air inlet may be provided in the end cap, at the edge of the inlet next to the cylindrical hollow tube, anywhere along the length of the cylindrical hollow tube, or at the connection of the battery portion 12 and the atomizer/liquid reservoir portion 14. FIG. 6 shows a pair of air inlets 38 provided at the intersection between the battery portion 12 and the atomizer/liquid reservoir portion 14.

A battery 18, a light emitting diode (LED) 20, control electronics 22 and optionally an airflow sensor 24 are provided within the cylindrical hollow tube battery portion 12. The battery 18 is electrically connected to the control electronics 22, which is electrically connected to the LED 20 and the airflow sensor 24. In this example the LED 20 is at the front end of the battery portion 12, adjacent to the end cap 16 and the control electronics 22 and airflow sensor 24 are provided in the central cavity at the other end of the battery 18 adjacent the atomizer/liquid reservoir portion 14.

The airflow sensor 24 acts as a puff detector, detecting a user puffing or sucking on the atomizer/liquid reservoir portion 14 of the e-cigarette 10. The airflow sensor 24 can be any suitable sensor for detecting changes in airflow or air pressure such a microphone switch including a deformable membrane which is caused to move by variations in air pressure. Alternatively the sensor may be a Hall element or an electro-mechanical sensor.

The control electronics 22 are also connected to an atomizer 26. In the example shown, the atomizer 26 includes a heating coil 28 which is wrapped around a wick 30 extending across a central passage 32 of the atomizer/liquid reservoir portion 14. The coil 28 may be positioned anywhere in the atomizer and may be transverse or parallel to the liquid reservoir 34. The wick 30 and heating coil 28 do not completely block the central passage 32. Rather an air gap is provided on either side of the heating coil 28 enabling air to flow past the heating coil 28 and the wick 30. The atomizer may alternatively use other forms of heating elements, such as ceramic heaters, or fiber or mesh material heaters. Nonresistance heating elements such as sonic, piezo and jet spray may also be used in the atomizer in place of the heating coil 28.

In FIG. 6 the central passage 32 is surrounded by a cylindrical liquid supply 34 with the ends of the wick 30 abutting or extending into the liquid supply 34. The wick 30 may be a porous material such as a bundle of fibers, with liquid in the liquid supply 34 drawn by capillary action from the ends of the wick 30 towards the central portion of the wick 30 encircled by the heating coil 28. In designs having a hollow cylindrical tank for holding e-liquid, the central passage 32 connects into the tank.

The liquid supply 34 may alternatively include wadding soaked in liquid which encircles the central passage 32 with the ends of the wick 30 abutting the wadding. In other embodiments the liquid supply 34 may comprise a toroidal cavity arranged to be filled with liquid and with the ends of the wick 30 extending into the toroidal cavity.

An air inhalation port 36 is provided at the back end of the atomizer/liquid reservoir portion 14 remote from the end cap 16. The inhalation port 36 may be formed in the atomizer/liquid reservoir portion 14 or it may be formed in a separate mouthpiece attached to the atomizer/liquid reservoir portion 14.

In use, a user sucks on the e-cigarette 10. This causes air to be drawn into the e-cigarette 10 via one or more air inlets, such as air inlets 38, and to be drawn through the central passage 32 towards the air inhalation port 36. The change in air pressure is detected by the airflow sensor 24 which generates an electrical signal that is passed to the control electronics 22. In response to the signal, the control electronics 22 activates the heating coil 28 which causes liquid in the wick 30 to be vaporized creating a vapor (which may have gas and liquid components) within the central passage 32. As the user continues to suck on the e-cigarette 10, the vapor is drawn through the central passage 32 and inhaled by the user. At the same time the control electronics 22 also activates the LED 20 causing the LED 20 to light up which is visible via the translucent end cap 16 simulating the appearance of a glowing ember at the end of a conventional cigarette. As liquid present in the wick 30 is converted into vapor more liquid is drawn into the wick 30 from the liquid supply 34 by capillary action and thus is available to be converted into vapor through subsequent activation of the heating coil 28.

Some electronic vaporizing devices are disposable, with the battery power sufficient only to vaporize the liquid contained within the liquid supply 34. After the liquid is consumed, the device is discarded. In other embodiments the battery 18 is rechargeable and the liquid supply is refillable. In the cases where the liquid supply 34 is a toroidal cavity, this may be achieved by refilling the liquid supply via a refill port. In other embodiments the atomizer/liquid reservoir portion 14 of the e-cigarette 10 is detachable from the battery portion 12 and a new atomizer/liquid reservoir portion 14 can be fitted with a new liquid supply 34 thereby replenishing the supply of liquid. In some cases, replacing the liquid supply 34 may involve replacement of the heating coil 28 and the wick 30 along with the replacement of the liquid supply 34.

The new liquid supply 34 may be in the form of a cartridge having a central passage 32 through which a user inhales vapor. In other embodiments, vapor may flow around the exterior of the cartridge to an air inhalation port 36.

Of course, in addition to the above description of the structure and function of a typical e-cigarette 10, variations also exist. For example, the LED 20 may be omitted.

The airflow sensor 24 may be placed adjacent the end cap 16 rather than in the middle of the e-cigarette. The airflow sensor 24 may be replaced with a switch which enables a user to activate the e-cigarette manually rather than in response to the detection of a change in air flow or air pressure.

Different types of atomizers may be used. Thus for example, the atomizer may have a heating coil in a cavity in the interior of a porous body soaked in liquid. In this design vapor is generated by evaporating the liquid within the porous body either by activation of the coil heating the porous body or alternatively by the heated air passing over or through the porous body. Alternatively the atomizer may use a piezoelectric atomizer to create vapor either in combination or in the absence of a heater.

Figure 1:
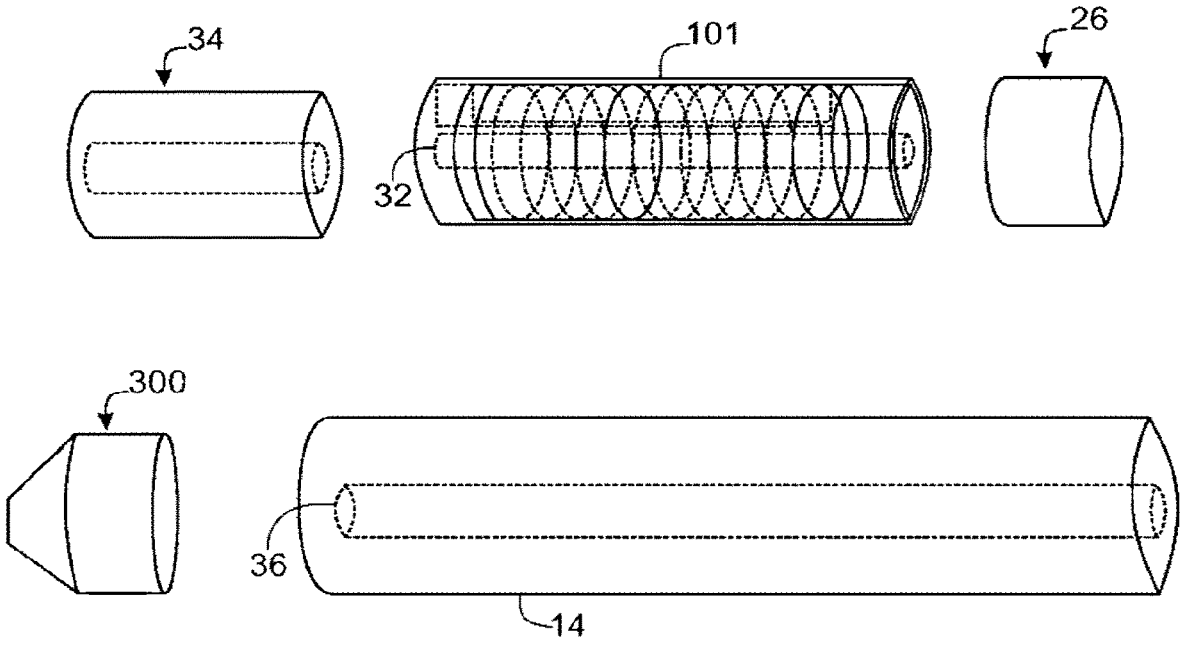
FIG. 1 is a perspective view of an electronic cigarette having a capillary buffer.

FIG. 1 is an exploded perspective view of an electronic vaporizing device 11 having a capillary buffer 101, a liquid supply 34 attached to a first end 33 of the capillary buffer 101, an atomizer 26 attached to a second end 35 of the capillary buffer 101, and a first housing holding the capillary buffer, the atomizer and the liquid supply. The device 11 generally also has a second housing that contains a battery and electronics, as shown in FIG. 6.

Figure 2A:
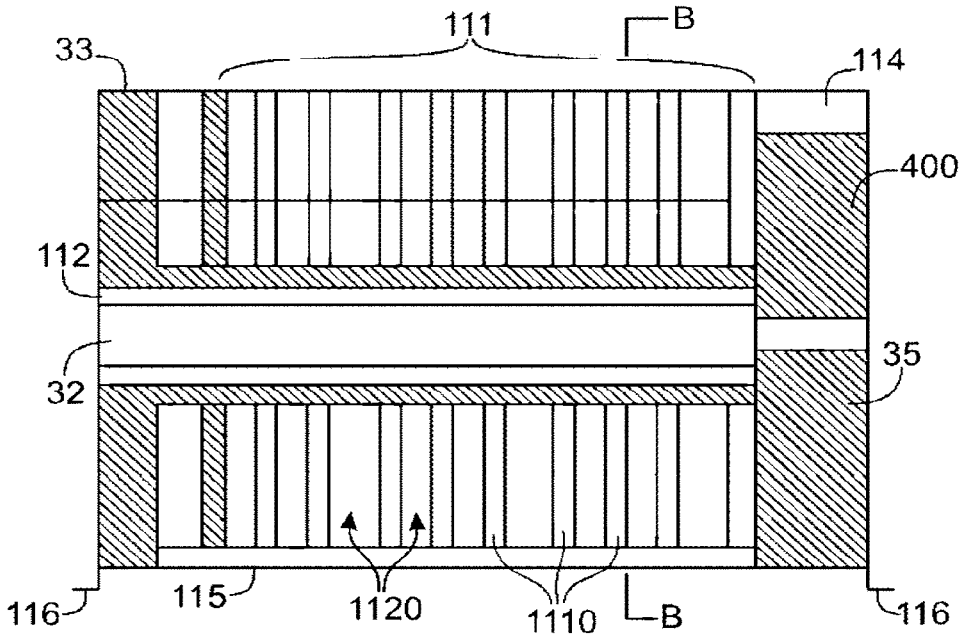
FIG. 2*a* is longitudinal sectional view of the capillary buffer shown in FIG. 1.
Figure 2B:
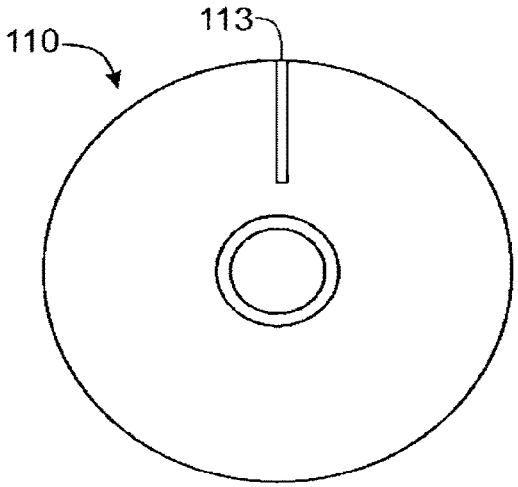
FIG. 2*b* is the B-B cross sectional view of the capillary buffer shown in FIG. 2*a;*
Figure 2C:
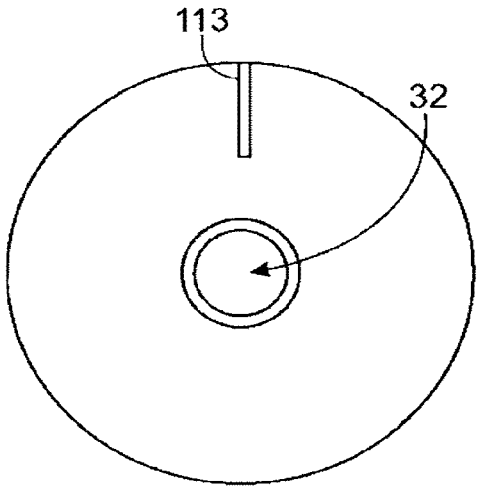
FIG. 2*c* is left side view of the capillary buffer of FIG. 2*a;*

As shown in FIGS. 2*a* to 2*c*, the capillary buffer 101 includes a liquid conduit 112 extending from the first end 33, through the capillary buffer, to the second end 35. The central passage or vapor channel 32 is also provided through the capillary buffer and may be coaxial with the liquid conduit 112. E-liquid can be conveyed to the atomizer 26 through the capillary buffer and through the liquid conduit. Vapor generated by the atomizer 26 is conveyed towards the mouthpiece or inhalation port 36 through the vapor channel 32.

The vapor channel 32 may be coaxial with the tubular housing of the e-cigarette. In other designs, the vapor channel 32 can be offset from the center axis or take other shapes instead of a straight tubular shape. The vapor channel and the liquid conduit may be parallel.

In FIG. 2*a* the capillary buffer 101 has a buffer portion 111 with an array of buffer spaces 1120 formed between buffer plates 1110. The spacing between the buffer plates 1110 may be uniform or varying. The buffer plates 1110 may be parallel to each other and perpendicular the central longitudinal axis of the housing. A typical spacing between adjacent buffer plates may be from 0.05~2 mm, and more preferably 0.1 to 0.7 mm, or about 0.5 mm. As shown in FIG. 2*b*, a capillary slit 113 is cut into the buffer plates 1110 in the capillary buffer portion 111. The capillary slit 113 extends from the last buffer plate near the second end 35 to a first buffer plate near the first end 33. The capillary slit 113*b* has a width of 0.01~0.5 mm and more preferably 0.05 to 0.2 mm, or about 0.1 mm An air vent 114 is provided on the second end 35 of the capillary buffer 101. The air vent 114 connects into the buffer spaces 1120 and to a housing vent in the housing. An air channel 115 extends through all the capillary buffer plates so that each capillary buffer space is connected to the air vent 114. This allows air to flow bi-directionally between any buffer space and the air vent 114. Connected as used here means arranged to allow flow between elements.

The capillary slit 113 can extend perpendicular to the buffer plates 1110 as shown in FIGS. 2*b* and 2*c*, or the capillary slit 113 can be formed at an angle relative to the buffer plates. The air channel 115 can be provided diametrically opposite to the position of the capillary slit 113.

The capillary buffer 101 can have flanges 116 at the first end 33 and the second end 35 for mounting it within the housing. Sealing agents can be used to enhance the sealing between the capillary buffer and the housing.

The second end 35 of the capillary buffer 101 can have a recess formed by an annular wall, for receiving the liquid guiding structure 400. The liquid guiding structure 400 blocks the liquid conduit 112 formed between the vapor channel 32 and the buffer plate section, and absorbs e-liquid supplied through the liquid conduit 112. The air vent 114 can be provided on the annular wall as a slot.

When the capillary buffer and the liquid supply are installed in the housing of the e-cigarette or vaporizing device, e-liquid from the liquid supply 34, such as a liquid cartridge or a liquid reservoir, moves through the liquid conduit 112*b* and optionally a liquid guiding structure 400, as shown in FIG. 2*a*. Under normal conditions, e-liquid travels though the liquid conduit 112 and reaches and saturates the liquid guiding structure 400. If pressure in the liquid container rises significantly, such as at high ambient temperatures, liquid will be pushed out of the container and flow along the slit 113 into the buffer spaces 1120 within the capillary buffer section. Air within the buffering spaces 1120 is pushed out of the capillary buffer 101 through the air channel 115 and the air vent 114. As a result, the buffering spaces 1120 can accommodate excessive flow of e-liquid from the liquid cartridge or container 34 so that the amount of liquid flow through the liquid conduit 112 remains the same as under normal conditions.

As e-liquid within the liquid supply 34 is consumed, the pressure within the liquid container may decrease, with air drawn in from the air vent 114 through the air channel into the buffer spaces 1120 and then through the capillary slit 113 into the liquid supply 34. If the buffer spaces 1120 are filled with e-liquid, the e-liquid will also be drawn into the liquid container. As the width of the slit is smaller than the width of one buffering space, the e-liquid within the buffering spaces will be drawn completely through the capillary slit 113 to the liquid supply under capillary effect. Hence, the buffer spaces 1120 will be emptied with the consumption of the e-liquid and will then be ready for the next e-liquid supply cycle.

In another embodiment, the capillary slit 113 and the air vent 114 can be provided on the same end of the capillary buffer, especially on the first end 33 of the capillary buffer, so that the liquid conduit and the vapor channel can be eliminated from the capillary buffer. In this design the atomizer can be arranged near or in the e-liquid, and e-liquid can be consumed at the atomizer without moving through the capillary buffer, with vapor generated at or within the liquid supply.

Figure 3:
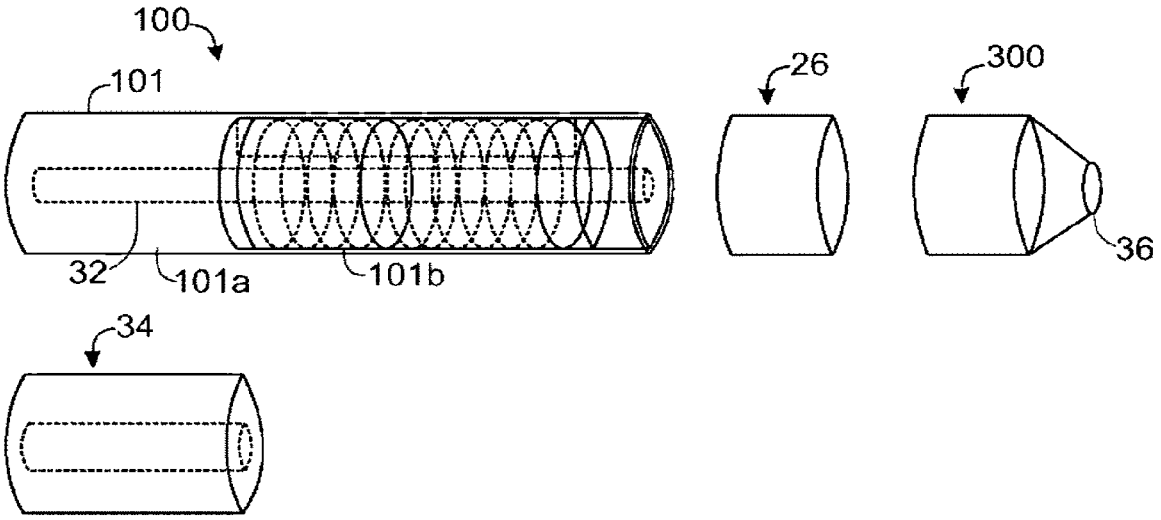
FIG. 3 is a perspective view of an electronic cigarette having liquid supply with capillary buffer section.
Figure 4A:
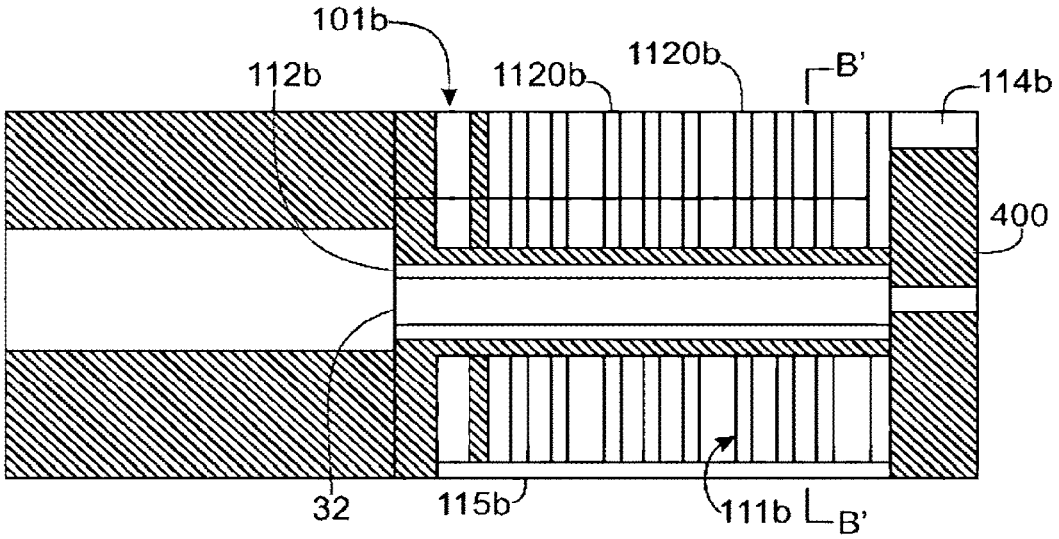
FIG. 4*a* is longitudinal sectional view of the capillary buffer of FIG. 3.

In FIGS. 3 and 4*a*, the liquid supply 100 has a liquid supply section 101*a* proximal to a first end of the housing. The liquid supply 34 and a capillary buffer section 101*b* abuts the liquid supply section 101*a*. The liquid supply further includes a liquid conduit and a vapor channel 32, both extending from the first end of the assembly, through the liquid supply section 101*a* and the capillary buffer section 101*b*, to the second end of the assembly to connect with a atomizer 26 and optionally a mouth piece 300. Liquid is directed from the liquid supply to the atomizer 26 and the vapor generated at the atomizer 26 flows towards the mouthpiece or inhalation port 36. The vapor channel 32 in FIG. 3 can be arranged coaxially to the housing. In other designs, the vapor channel 32 can be offset from the center axis or take other shapes instead of a straight tubular shape.

In some embodiments, the liquid supply section 101*a* and the capillary buffer section 101*b* can be formed as one piece as illustrated in FIGS. 3 and 4. Alternatively, they can be formed separately and coupled to one another via connecting mechanisms such as threads or snap fit connections, as illustrated in FIGS. 3*a* and 4. Both sections can be made from metal or plastic materials. The housing may be transparent. FIG. 4 shows a liquid supply section attached to a capillary buffer, as may be used in the device shown in FIG. 6.

Figure 5A:
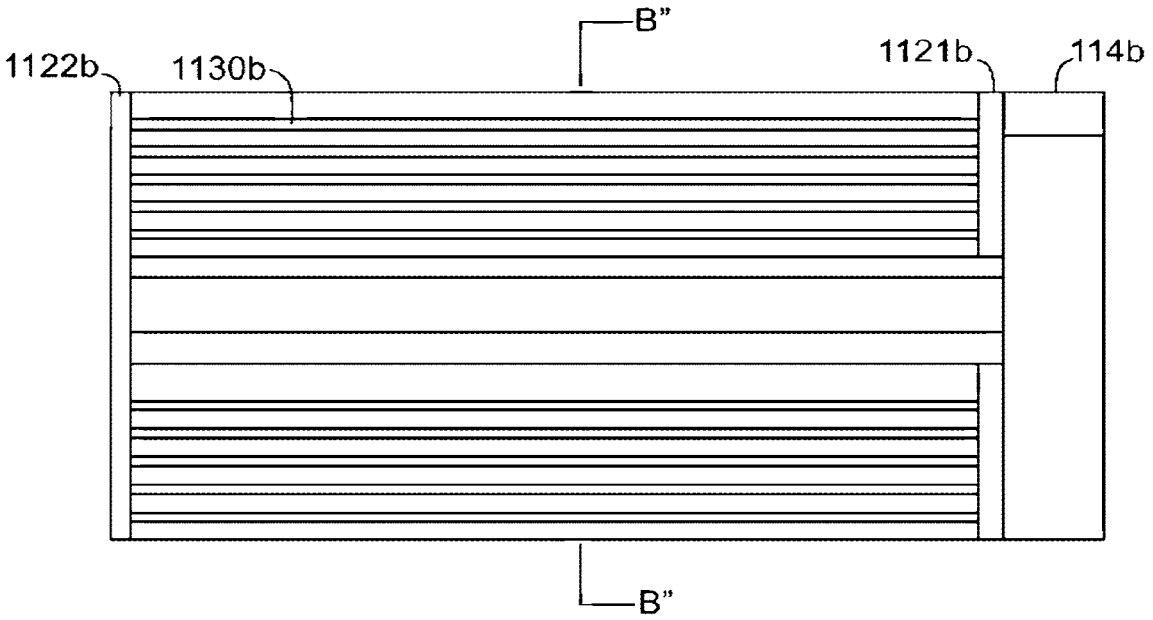
FIG. 5*a* is longitudinal sectional view of another capillary buffer.
Figure 5B:
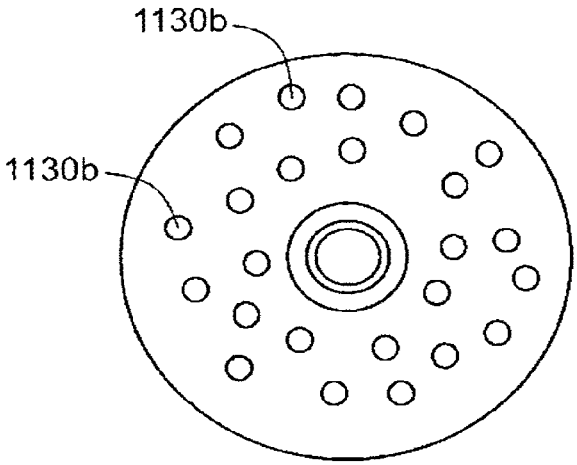
FIG. 5*b* is the B"-B" cross sectional view of the capillary buffer of FIG. 5*a;*
Figure 5C:
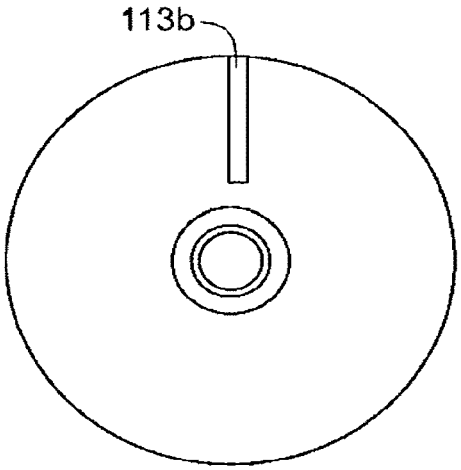
FIG. 5*c* is left side view of the capillary buffer in FIG. 2*a;*

In FIGS. 5*a* to 5*c*, the capillary buffer section 101*b* can also be configured to have multiple capillary channels 1130B instead of parallel buffering plates. The capillary channels 1130B can be arranged parallel to the vapor channel 32 or at an angle to the vapor channel. The capillary channels are vented to ambient through a distal buffer space 1121B formed at the second end of the capillary buffer section 101*b*, and via a vent opening provided on an end of the buffer section. The capillary channels 1130B connect with the liquid cartridge through a proximal buffer space 1122B formed at the first end of the capillary buffer section 101*b* and via a capillary slit 113*b* formed on the first end. The cross section of the capillary channel 1130B can be round, oval, square, triangular, rectangular, star, hexagonal, octagonal or other shape. The diameter of the capillary channel can be less than 0.2 mm.

From the foregoing, it will be appreciated that specific embodiments of the invention have been described herein for purposes of illustration, but that various modifications may be made without deviating from the scope of the invention. Accordingly, the invention is not limited except as by the appended claims.

The invention claimed is:

1. An electronic vaporizing device comprising:

a tubular housing;

an atomizer, a capillary buffer and a liquid supply arranged sequentially in the housing;

the capillary buffer having a first end, a second end, and a capillary buffer portion between the first end and the second end, and a vapor channel;

the vapor channel co-axial with the tubular housing;

the capillary buffer in between the liquid supply and the atomizer;

the vapor channel leading to the atomizer; and the capillary buffer portion including a liquid conduit between the first end and the second end, through the capillary buffer portion, the liquid supply connecting into the liquid conduit, the capillary buffer portion comprising a plurality of buffer spaces formed between a plurality of buffer plates, an air channel connecting into all of the buffer spaces, and a capillary slit through and perpendicular the buffer plates.

2. The electronic vaporizing device of claim 1 further including a recess at the first end of the capillary buffer portion for accommodating a liquid guiding structure.

3. The electronic vaporizing device of claim 1 wherein the air channel is opposite from the capillary slit.

4. The electronic vaporizing device of claim 1 wherein the capillary buffer portion is adapted to hold excess liquid from the liquid supply in the buffer spaces.

5. The electronic vaporizing device of claim 1 further including a fiber material in the liquid supply.

6. The electronic vaporizing device of claim 1 wherein the capillary buffer and the liquid supply comprise a single component.

7. The electronic vaporizing device of claim 1 wherein the capillary slit has a width of 0.05 to 0.2 mm.

8. The electronic vaporizing device of claim 1 wherein the capillary slit is parallel to a longitudinal axis of the device.

9. The electronic vaporizing device of claim 1 with the capillary slit is radially offset from the air channel.

10. The electronic vaporizing device of claim 1 wherein the buffer plates are parallel to each other and perpendicular to the capillary slit.

11. The electronic vaporizing device of claim 1 further comprising an air vent in the capillary buffer connected to the air channel, with the air vent connecting to a housing vent, to allow bi-directional airflow in the air channel.

12. The electronic vaporizing device of claim 1 with the air channel diametrically opposite from the capillary slit.

13. An electronic vaporizing device comprising:

a tubular housing;

an atomizer, a capillary buffer and a liquid supply arranged sequentially and coaxially in the housing;

the capillary buffer including a first end, a second end, and a capillary buffer portion between the first end and the second end;

the capillary buffer further including a vapor channel co-axial with the tubular housing;

the capillary buffer in between the liquid supply and the atomizer;

the vapor channel leading to the atomizer;

the capillary buffer portion including a liquid conduit between the first end and the second end, and through the capillary buffer portion;

the liquid supply connecting into the liquid conduit; and the capillary buffer portion further including a plurality of buffer spaces formed between a plurality of buffer plates, an air channel connecting into all of the buffer spaces, and a capillary slit cut through the buffer plates perpendicular to the buffer plates and parallel to a longitudinal axis of the tubular housing.

14. The electronic vaporizing device of claim 13 further comprising an air vent in the capillary buffer connected to the air channel, with the air vent connecting to a housing vent, to allow bi-directional airflow in the air channel.

15. The electronic vaporizing device of claim 14 with the air channel diametrically opposite from the capillary slit.

* * * * *